United States Patent [19]

Lee et al.

[11] 4,256,270

[45] Mar. 17, 1981

[54] TENSION CONTROL SYSTEM FOR AN UNWINDER

[75] Inventors: Frank X. Lee, New York; Leonard C. Krimsky, Spring Valley, both of N.Y.

[73] Assignee: Worldwide Converting Machinery, Inc., Allendale, N.J.

[21] Appl. No.: 63,705

[22] Filed: Aug. 6, 1979

[51] Int. Cl.[3] ..... B65H 19/00; B65H 17/02

[52] U.S. Cl. ..... 242/75.5

[58] Field of Search ..... 242/75.5, 75.51, 75.52, 242/75.4, 75.43, 75.44, 75.47

[56] References Cited

U.S. PATENT DOCUMENTS

| | | | |
|---|---|---|---|
| 2,392,226 | 1/1946 | Butterworth | 242/75.5 |
| 2,859,923 | 11/1958 | Bowen | 242/75.47 |
| 2,916,227 | 12/1959 | Bowen | 242/75.5 |
| 2,937,819 | 5/1960 | Bowen | 242/75.5 |
| 3,145,945 | 8/1969 | Bowen | 242/75.5 X |

*Primary Examiner*—Edward J. McCarthy

*Attorney, Agent, or Firm*—Shenier & O'Connor

[57] ABSTRACT

A tension control system for an unwinder in which a mechanical differential continuously couples to the roll mandrel an unwinding torque which is at least equal to the torque necessary to overcome the friction in the system.

6 Claims, 3 Drawing Figures

TENSION CONTROL SYSTEM FOR AN UNWINDER

BACKGROUND OF THE INVENTION

In installations in which material such, for example, as photographic film is being unwound from a roll into a coating station, tension in the material usually is controlled by a pneumatic brake, or in some instances a more sophisticated brake of the eddy current type. More specifically, in such systems material is drawn off the supply roll by a pair of rolls which feed the material toward the process station. In response to changes in tension in the film, a dancer roll moves to actuate the brake to restore the tension to the desired value.

Systems of the type described above work well when the roll diameter is relatively big, since at a large roll radius a given tension in the material results in a fairly high torque at the roll shaft. A problem arises when the material has been wound down to a point at which the core is being approached. At this point, the effective radius of a roll may only be about an inch-and-a-half. Under this condition, if the system is running with a tension of about 5 pounds total, the torque at the roll shaft is only about 7½ inch pounds. At this value of torque, not only is the brake out of its control range because the torque is too low for the pressure to adjust and control the tension, but also, just the friction in the system usually is higher than that torque level. As a result without any braking at all on the machine the tension is increasing above the desired level.

In the prior art, attempts to solve the problem outlined above have been brute force methods. That is to say, a torque motor or the like is coupled to the unwinding spindle and by means of switching it supplies torque to the spindle to overcome the residual friction. In effect, the entire system is biased to such a level that the brake always is operating and it never sees less than a 10-inch pound torque, for example, at the roll shaft. While such a system is feasible, where a turret is being used to support a plurality of rolls a great deal of hardware and much sequencing of the drive motor is required. This additional equipment is used only for a few minutes during the entire unwinding operation when you are down near the core.

As an alternative to the system described above, a DC motor can be coupled to the unwinding shaft so as to act as a generator and provide braking action during the major part of the unwinding operation. When the unwinding operation has proceeded to a point at which the core is being approached, the DC motor automatically responds to a dancer roll so as to become a motor and drive to supply torque to the system. While this is a solution to the problem, it is an extremely expensive solution.

SUMMARY OF THE INVENTION

Our invention relates to a tension control system for an unwinder in which a mechanical differential continuously couples to the roll mandrel an unwinding torque which is at least equal to the torque necessary to overcome the friction in the system.

One object of our invention is to provide a tension control system for an unwinder in which a torque assist is provided at small roll diameters.

Another object of our invention is to provide a tension control system for an unwinder with a torque assist arrangement at small roll diameters which is simpler than are torque assist systems of the prior art.

A further object of our invention is to provide a tension control system for unwinder with a torque assist system which is less expensive than are torque assist systems of the prior art.

A still further object of our invention is to provide a tension control system for an unwinder having a torque assist system which operates in an expeditious manner to provide torque at small roll diameters.

Other and further objects of our invention will appear from the following description.

BRIEF DESCRIPTION OF THE DRAWINGS

In the accompanying drawings which form part of the instant specification and which are to be read in conjunction therewith and in which like reference numerals are used to indicate like parts in the various views.

DESCRIPTION OF THE PREFERRED EMBODIMENT

Figure 1:
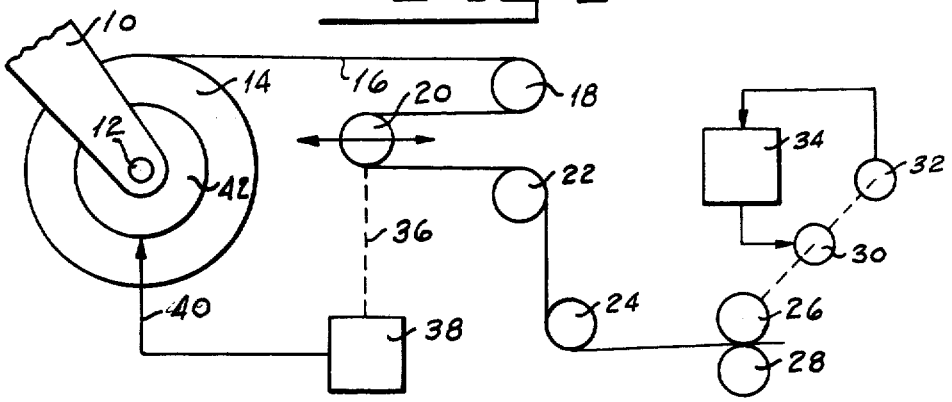
FIG. 1 is a schematic view illustrating one form of tension control system for an unwinder.

Referring now to FIG. 1, in one form of unwinding system known in the prior art, a pair of roll stand arms, one arm 10 of which is illustrated in FIG. 1, support a mandrel 12 carrying a roll 14 of material, such for example as film 16 being unwound. The film 16 passes around a stationary guide roll 18 and around a dancer roll 20 supported for movement laterally along a path indicated by the double-headed arrow in FIG. 1. After leaving the dancer roll 20, the material 16 passes around another guide roll 22, a third guide roll 24 and through the nip between a pair of feed rolls 26 and 28. A motor 30 is energized to drive the roll 26 to draw the film 16 off roll 14 and to feed it to a process station (not shown). A tachometer 32 responsive to the motor 30 provides an input signal to a control circuit 34 to control the energization of motor 30 so that the film 16 is drawn off the roll 14 at the desired rate.

As the tension in the film 16 varies, dancer roll 20 moves to the right or to the left as viewed in FIG. 1. This movement is translated to a control device 38 through means indicated schematically by the broken line 36 in FIG. 1. In response to the positioning of the roll 20, the control circuit 38 puts out a signal on a line 40 to actuate a brake 42 of any suitable type known to the art to exert sufficient braking force on the mandrel 12 to provide the desired tension in the film 16.

Figure 2:
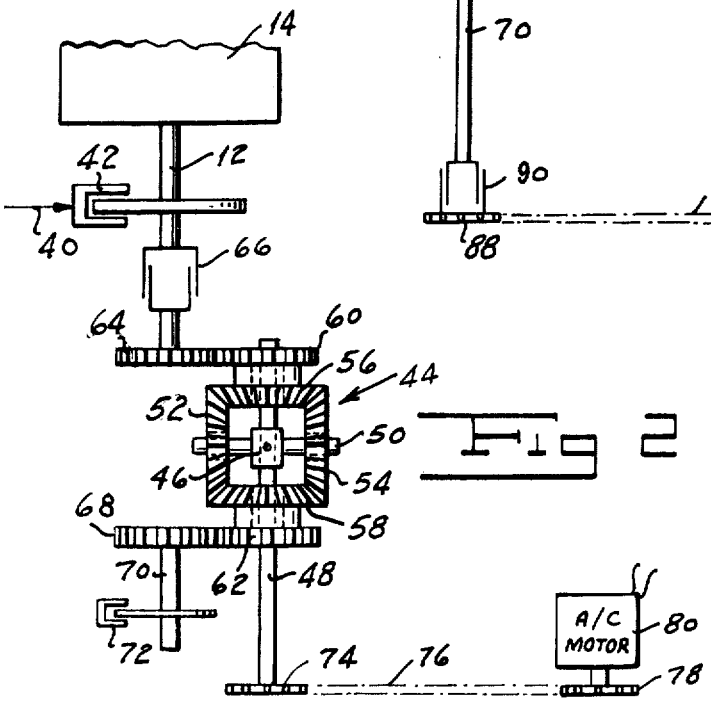
FIG. 2 is a partially schematic view of our torque assist system applied to the tension control system illustrated in FIG. 1.

Referring now to FIG. 2, our torque assist arrangement applied to the unwinding arrangement illustrated in FIG. 1 includes a differential indicated generally by the reference character 44 having a spider 46 including a pair of cross shafts 48 and 50. Shaft 50 rotatably supports a pair of bevel gears 52 and 54 which mesh with a pair of side bevel gears 56 and 58 rotatably supported on the cross shaft 48.

We secure respective pinions 60 and 62 to the side gears 56 and 58 for rotation therewith. Gear 60 is in driving engagement with a gear 64 connected to the shaft 12 by means of a coupling 66. A pinion 62 secured to the other side gear 58 for rotation therewith meshes with a pinion 68 carried by a shaft 70 to which a braking force can be applied by a small brake 72.

A sprocket wheel 74 on shaft 48 for rotation therewith is connected to another sprocket wheel 78 by means of a pitch chain 76. An AC motor 80 is adapted to be energized to drive sprocket wheel 78 and thereby to drive cross shaft 48.

As is known in the art, in a differential such as a differential 44, the torque at side gear 56 always is equal to the torque at side gear 58. Moreover, the speed of rotation of the spider 46 is equal to half the algebraic sum of the speeds of the side gears 56 and 58. In our arrangement, we set the small caliper brake 72 to exert, for example, ten-inch pounds of torque on the shaft 70. We then energize motor 80 to drive shaft 48 at some speed which is higher than the differential will ever have to go. Under these conditions with shaft 48 driven in a clockwise direction as viewed from the bottom in FIG. 2, side gear 56 will put out a biasing torque of approximately ten-inch pounds on mandrel 12 in the unwinding direction of drive of roll 14. To summarize, rolls 26 and 28 determine the line speed at which the material 16 is pulled off the roll 14. The torque in both side gears 56 and 58 is equal. The spindle brake 42, which is controlled by the dancer roll 20, puts out an amount of drag torque required to produce the actual tension in material 16, plus the ten-inch pounds of biasing torque. This ten-inch pounds of biasing torque is continuously in the system as a bias in the positive direction. As the roll 14 decreases in diameter, brake 42 is required to put out less and less torque in order to maintain constant tension. At some point near the core the torque required becomes less than the friction in the spindle support bearings. At this point the brake 42 would normally shut off and web tension due to friction alone would exceed the dancer roll setting. With the ten-inch pound bias added to the system the brake continues to put out drag torque and remains responsive to the signals put out by the dancer roll.

It will be readily appreciated by those skilled in the art that the use of the differential 44, together with the small brake 72 and the constant speed motor 80, is relatively inexpensive as compared to a DC motor or any current control drive system which changes speed. Motor 80 never changes speed. The two side gears 56 and 58 change speeds. When the diameter of roll 14 is relatively large, side gear 58 is rotating very rapidly while the side gear 56 is rotating relatively slowly. As the roll diameter decreases relationship between these speeds change.

The system just described operates extremely well in an unwinding installation in which there is no requirement for flying splices between successive rolls in the course of the unwinding operation. In many installations, however, such a flying splice may be required to be achieved in the manner described, for example, in Lee et al U.S. Pat No. 3,944,151.

Figure 3:
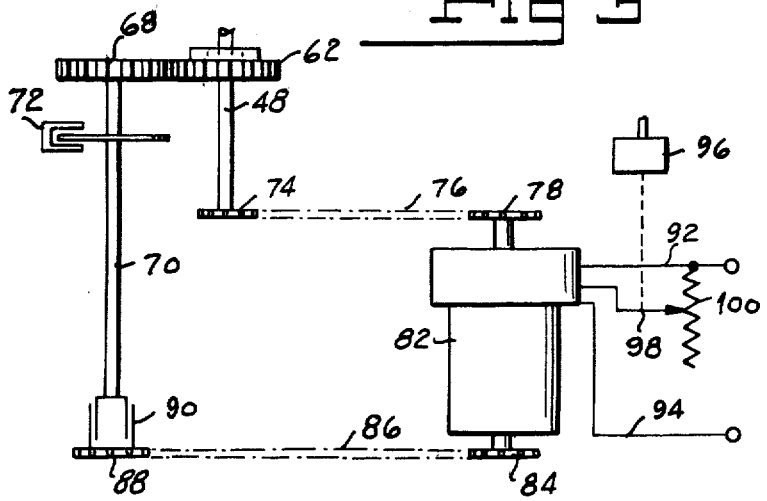
FIG. 3 is a partially schematic view of an alternate form of our torque assist system for an unwinder.

Referring now to FIG. 3, we show a form of our torque assist system in which provision is made for driving a new roll up to line speed to permit the splicing operation to take place in the manner described, for example, in the Lee et al patent referred to hereinabove while at the same time applying torque assist to the expiring roll as it nears the core. In this system, we replace the AC motor 80 with a small DC motor 82. Motor 82 operates at constant speed to drive the pinion 62 through pitch chain 76 against the action of brake 72 in providing the torque assist in the course of a normal unwinding operation. However, when a new roll is to be brought up to line speed, brake 72 is released and a clutch 90 is engaged to cause the motor 82 to drive shaft 70 through a pitch chain 86. Motor 82 is energized from a pair of lines 92 and 94. A tachometer 96 may be used to move a brush 98 along a resistance 100 to control the speed of motor 82 in accordance with line speed variations. It will further be appreciated that brush 98 can manually be initially set to a desired speed. In operation of this system, the operator first sets brush 98 at a speed corresponding to the diameter of the new roll. Tachometer 96 then causes the motor to follow the ups and downs of line speed. At the proper time for splicing, as is pointed out in the Lee et al patent referred to hereinabove, the glue line is sensed and the bump and cut operations take place. At the end of that sequence, clutch 90 is disengaged and brake 72 is engaged. It will be readily appreciated that application of the brake is not critical because the dancer roll is controlling the main brake 42. That is to say, at this point and time the roll 14 is at a large diameter and the biasing torque provided by brake 72 will not be required for some time.

It will be seen that we have accomplished the objects of our invention. We have provided a tension control system for an unwinder which is an improvement over tension control systems to prior art. Our system provides a biasing torque in a simple, inexpensive and expeditious manner.

It will be understood that certain features and subcombinations are of utility and may be employed without reference to other features and subcombinations. This is contemplated by and is within the scope of our claims. It is further obvious that various changes may be made in details within the scope of our claims without departing from the spirit of our invention. It is, therefore, to be understood that our invention is not to be limited to the specific details shown and described.

Having thus described our invention, what we claim is:

1. In a system for unwinding material from a roll having a mandrel, apparatus including means for withdrawing material from said mandrel at a desired rate, means for exerting a retarding torque on said mandrel to regulate the tension in said material in the course of an unwinding operation, a mechanical differential having a pair of side gears and an input shaft, means for coupling one of said side gears to said mandrel, means for applying a braking force to the other side gear, and means operative during an unwinding operation for driving said input shaft in such a direction as to apply to said mandrel a biasing torque in a direction opposite to the direction of said retarding torque.

2. Apparatus as in claim 1 in which said input shaft driving means is an AC motor.

3. In a system for unwinding material from a roll having a mandrel, apparatus including means for withdrawing material from said mandrel at a desired rate, means for exerting a retarding torque on said mandrel to control the tension in said material, and means operative during an unwinding operation including a mechanical differential for applying to said mandrel a biasing torque in a direction opposite to said retarding torque.

4. In a system for unwinding material from a roll having a mandrel, apparatus including means for withdrawing material from said mandrel at a desired rate, means for exerting a retarding torque on said mandrel to control the tension in said material, and means operative continuously in the course of an unwinding operation for applying to said mandrel a biasing torque in a direction opposite to said retarding torque.

5. In a system for unwinding material from a roll having a mandrel, apparatus including means for withdrawing material from said mandrel at a desired rate, means for exerting a retarding torque on said mandrel to control the tension in said material in the course of an unwinding operation, a mechanical differential having a pair of side gears and an input shaft, means coupling one of said side gears to said mandrel, releasable means for exerting a braking force on said side gear, a motor, drive means operative during an unwinding operation for coupling said motor to said input shaft to drive said shaft in such a direction as to exert a biasing torque on said mandrel in a direction opposite to said retarding torque and actuatable means for coupling said motor to said side gear, said releasable means adapted to be released concomitantly with the actuation of said actuatable means when a new roll is to be unwound.

6. Apparatus as in claim 5 in which said motor is a variable speed motor, said apparatus including means for varying said motor speed in response to line speed variations.

* * * * *